US006871503B1

(12) United States Patent
Inoue et al.

(10) Patent No.: US 6,871,503 B1
(45) Date of Patent: Mar. 29, 2005

(54) GAS TURBINE COMBUSTOR WITH FUEL-AIR PRE-MIXER AND PRE-MIXING METHOD FOR LOW NOX COMBUSTION

(75) Inventors: Hiroshi Inoue, Hitachinaka (JP); Tomomi Koganezawa, Hitachi (JP); Nariyoshi Kobayashi, Hitachinaka (JP); Masaya Ohtsuka, Mito (JP); Kazuyuki Ito, Hitachinaka (JP); Isao Takehara, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/088,114

(22) PCT Filed: Oct. 20, 1999

(86) PCT No.: PCT/JP99/05779

§ 371 (c)(1),
(2), (4) Date: Jul. 18, 2002

(87) PCT Pub. No.: WO01/29484

PCT Pub. Date: Apr. 26, 2001

(51) Int. Cl.[7] ..... F02C 7/22
(52) U.S. Cl. ..... 60/776; 60/737; 60/746
(58) Field of Search ..... 60/737, 738, 746, 60/747, 776, 39.01, 39.1, 722, 735, 772, 773, 774, 775, 777, 778, 779, 780, 781, 782, 39.183

(56) References Cited

U.S. PATENT DOCUMENTS

| | | | | | |
|---|---|---|---|---|---|
| 4,677,822 | A | * | 7/1987 | Iizuka et al. | 60/747 |
| 4,829,764 | A | * | 5/1989 | Iizuka et al. | 60/746 |
| 4,898,001 | A | * | 2/1990 | Kuroda et al. | 60/733 |
| 5,069,029 | A | * | 12/1991 | Kuroda et al. | 60/737 |
| 5,121,597 | A | * | 6/1992 | Urushidani et al. | 60/733 |
| 5,323,614 | A | * | 6/1994 | Tsukahara et al. | 60/737 |
| 5,349,812 | A | * | 9/1994 | Taniguchi et al. | 60/39.23 |
| 5,660,045 | A | * | 8/1997 | Ito et al. | 60/737 |
| 6,092,362 | A | * | 7/2000 | Nagafuchi et al. | 60/39.821 |

FOREIGN PATENT DOCUMENTS

| | | | | | |
|---|---|---|---|---|---|
| JP | 55046309 | A | * | 4/1980 | F23R/3/28 |
| JP | 355046309 | A | * | 4/1980 | |
| JP | 60-223587 | | | 11/1985 | |
| JP | 361119920 | A | * | 6/1986 | |
| JP | 362175524 | A | * | 8/1987 | |
| JP | 2-267419 | | | 11/1990 | |
| JP | 3-175211 | | | 7/1991 | |
| JP | 7-260148 | | | 10/1995 | |
| JP | 8-135969 | | | 5/1996 | |
| JP | 08135969 | A | * | 5/1996 | F23R/3/26 |
| JP | 408135969 | A | * | 5/1996 | |
| JP | 8-303778 | | | 11/1996 | |
| JP | 10-54560 | | | 2/1998 | |

* cited by examiner

*Primary Examiner*—Charles G. Freay
(74) *Attorney, Agent, or Firm*—Mattingly, Stanger, Malur & Brundidge, P.C.

(57) ABSTRACT

The purpose is to improve the mixture ratio of a pre-mixer by a simple arrangement to form a more uniform premixed gases so as to materialize low NOx combustion. Two fuel nozzles disposed circumferentially of a pre-mixer are combined with a single air intake window to make a set, which set is used to produce swirls in a pair, thereby expediting mixing. Further, the inlet window is shaped such that its circumferential width is changed axially of the combustor, thereby changing the strength and size of the swirls to achieve the greatest effect. By reducing both the pre-mixer inlet windows and the partition walls in number, the manufacturing cost can be reduced, and by strengthening and optimizing the swirls, a combustor with superior low NOx performance can be provided, while it is possible to reduce the length of the pre-mixer necessary to obtain the same mixture ratio, leading to a cost reduction.

8 Claims, 15 Drawing Sheets

5-5 CROSS SECTION 7-7 CROSS SECTION 13-13 CROSS SECTION 16-16 CROSS SECTION 19-19 CROSS SECTION 27-27 CROSS SECTION 33-33 CROSS SECTION 38-38 CROSS SECTION

GAS TURBINE COMBUSTOR WITH FUEL-AIR PRE-MIXER AND PRE-MIXING METHOD FOR LOW NOX COMBUSTION

FIELD OF THE INVENTION

The present invention relates to a premixer for gas turbine combustors, a premixing method for gas turbine combustors, a gas turbine combustor and a combustion method for gas turbine.

BACKGROUND ART

In a gas turbine combustor and a combustion method for gas turbines, in order to reduce exhaust amount of NOx which is an air pollution material, an application of premixing combustion method is now progressing in which fuel and air premixed before the fuel is introduced into a combustion chamber. For example, as disclosed in JP-A-3-175211 (1991), a diffusive combustion showing excellent stability is assigned at the center portion of the combustion chamber and a premixing combustion showing excellent low NOx property is assigned at the outer circumferential side thereof, thereby, NOx reduction is achieved. In this disclosure, air sent from a compressor passes between a combustor outer cylinder and a combustor liner and flows in respectively such as a combustion chamber and a pre-mixer.

Diffusive combustion use fuel is injected from a diffusion fuel nozzle into the combustion chamber to form stable diffusive flame and premixing use fuel is injected from a premixing fuel nozzle into an annular premixer to mix air and to from premixed gas.

The above premixed gas flows out into the combustion chamber to form premixing flame. The generated high temperature combustion gas is introduced into a turbine to perform works and thereafter is exhausted.

In a low NOx combustor making use of such premixing combustion, formation of uniform premixed gas greatly affects the low NOx performance. In particular, in the above conventional example which is structured in such a manner that the air flow makes a U turn at the inlet of the premixer, a drift with regard to air flow is likely caused which makes difficult to form a uniform mixing gas. Namely, for such measure it requires great attention of advancing the mixing in the premixer.

With regard to air flow in such premixer, JP-A-60-223578 (1985) and JP-A-2-267419 (1990), for example, disclose technical measures therefor.

JP-A-2-267419 (1990) discloses such a technique that a partition wall is provided for every nozzles so as to separate the same in the circumferential direction in the premixer, inlet windows of which opening is deviated are provided so that premixing combustion use air flows in an deviated manner, thereby a swirl component is caused in the premixing combustion use air and the mixing with fuel is advanced. However, the disclosure does not fully takes into account the relationship between the window configuration and the fuel nozzles.

An object of the present invention is to provide a premixer for gas turbine combustor, a premixing method for gas turbine combustors, a gas turbine combustor and a combustion method for gas turbines which uniformalize the premixing and show an excellent low NOx performance.

A gas turbine combustor according to the present invention comprising diffusive combustion nozzles which inject fuel and air into a combustion chamber and form a diffusive combustion flame, outer and inner walls which from an annular premixing flow passage and premixing nozzles which are disposed in the premixing flow passage and form a premixing combustion flame by injecting premixed gas formed by premixing fuel and air into the combustion chamber, is characterized in that a plurality of the premixing nozzles are arranged in the premixing flow passage; opening portions permitting air to flow in are provided at the outer wall so that the air flowed into the premixing flow passage forms swirling flow with respect to the premixing nozzles; and the opening portions are disposed in circumferential direction and are provided one for every adjacent two premixing nozzles.

A gas turbine combustor according to another aspect of the present invention comprising diffusive combustion nozzles which inject fuel and air into a combustion chamber and form a diffusive combustion flame, outer and inner walls which form an annular premixing flow passage and a premixing nozzles which are disposed in the premixing flow passage and form a premixing combustion flame by injecting premixed gas formed by premixing fuel and air into the combustion chamber, is characterized in that a plurality of the premixing nozzles are arranged in the premixing flow passage; opening portions permitting air to flow in are provided at the outer wall so that the air flowed into the premixing flow passage forms swirling flow with respect to the premixing nozzles; and the opening portions are disposed in circumferential direction and are provided one for every adjacent two premixing nozzles and the rotating directions of the swirling flows for the respective two premixing nozzles are caused to direct opposite direction each other.

A gas turbine combustor according to still another aspect of the present invention comprises: diffusive combustion nozzles which inject fuel and air into a combustion chamber and form a diffusive combustion flame; an inner cylinder arranged outside the diffusive combustion nozzles; a plurality of premixing nozzles which are arranged outside the inner cylinder circumferential direction and form a premixing combustion flame by injecting premixed gas formed by premixing fuel and air into the combustion chamber; and means for forming respective swirling flows of different rotating direction for the adjacent two premixing nozzles in circumferential direction.

A gas turbine combustor according to a further aspect of the present invention comprising diffusive combustion nozzles which inject fuel and air into a combustion chamber and form a diffusive combustion flame, outer and inner walls which form an annular premixing flow passage and premixing nozzles which are disposed in the premixing flow passages and form a premixing combustion flame by injecting premixed gas formed by premixing fuel and air into the combustion chamber, is characterized in that a plurality of the premixing nozzles are arranged in the premixing flow passage; and opening portions permitting air to flow in are provided at the outer wall so that the air flowed into the premixing flow passage forms swirling flows for the adjacent two premixing nozzles.

A gas turbine combustor according to a still further aspect of the present invention comprising diffusive combustion nozzles which inject fuel and air into a combustion chamber and form a diffusive combustion flame, outer and inner walls which form an annular premixing flow passage and premixing nozzles which are disposed in the premixing flow passage and form a premixing combustion flame by injecting premixed gas formed by premixing fuel and air into the combustion chamber, is characterized in that a plurality of the premixing nozzles are arranged in the premixing flow passage; opening portions permitting air to flow in into the premixing flow passage are provided at the outer wall and at portions between adjacent two premixing nozzles in the circumferential direction; and isolation wall members which are provided respectively at both sides of the adjacent two premixing nozzles in the circumferential direction.

A gas turbine combustor according to a still further aspect of the present invention comprises: diffusive combustion nozzles which inject fuel and air into a combustion chamber and form a diffusive combustion flame; an inner cylinder arranged outside the diffusive combustion nozzles; a plurality of premixing nozzles arranged outside the inner cylinder in circumferential direction and form a premixing combustion flame by injecting premixed gas formed by premixing fuel and air into the combustion chamber; means for forming respective swirling flows of different rotating direction for the adjacent two premixing nozzles in circumferential direction; and a member which surrounds the adjacent two premixing nozzles in the circumferential direction along the axial direction thereof.

A gas turbine combustor according to a still further aspect of the present invention comprising diffusive combustion nozzles which inject fuel and air into a combustion chamber and form a diffusive combustion flame, outer and inner walls which form an annular premixing flow passage and premixing nozzles which are disposed in the premixing flow passage and form a premixing combustion flame by injecting premixed gas formed by premixing fuel and air into the combustion chamber, is characterized in that a plurality of the premixing nozzles are arranged in the premixing flow passage; and opening portions permitting air to flow in are provided at the outer wall so that the air flowed into the premixing flow passage forms swirling flows with respect to the premixing nozzles, thereby, the rotating directions of the swirling flows for the respective two premixing nozzles are caused to direct opposite directions each other.

A gas turbine combustor according to a still further aspect of the present invention comprises diffusive combustion nozzles which inject fuel and air into a combustion chamber and form a diffusive combustion flame, outer and inner walls which form an annular premixing flow passage and premixing nozzles which are disposed in the premixing flow passage and form a premixing combustion flame by injecting premixed gas formed by premixing fuel and air into the combustion chamber, wherein a plurality of the premixing nozzles are arranged in the premixing flow passage; opening portions permitting air to flow in are provided at the outer wall so that the air flowed into the premixing flow passage forms swirling flow with respect to the premixing nozzles; and each of the opening portions is configured in nearly a triangular shape in such a manner either that the opening broadens in the main air stream direction prior to flowing into the premixer or that the opening decreases in the main air stream direction prior to flowing into the premixer; and the rotating directions of the swirling flows for the respective two premixing nozzles are caused to direct opposite directions each other.

A gas turbine combustor use premixing device according to one aspect of the present invention comprising a plurality of premixing nozzles which are arranged in circumferential direction and form a premixing combustion flame by injecting premixed gas formed by premixing fuel and air into a combustion chamber, is characterized in that one air flow inlet for every adjacent two premixing nozzles is provided so that a swirling flow is formed for the respective adjacent two premixing nozzles in the circumferential direction.

A gas turbine combustor use premixing device according to another aspect of the present invention comprising a plurality of premixing nozzles which are arranged in circumferential direction and form a premixing combustion flame by injecting premixed gas formed by premixing fuel and air into a combustion chamber, is characterized in that one air flow inlet for every adjacent two premixing nozzles is provided so that swirling flows of which rotating directions are opposite each other are formed for the respective adjacent two premixing nozzles in the circumferential direction.

A gas turbine combustor use premixing device according to still another aspect of the present invention comprising a plurality of premixing nozzles which are arranged in circumferential direction and form a premixing combustion flame by injecting premixed gas formed by premixing fuel and air into a combustion chamber, is characterized in that means is provided which forms swirling flows of which rotating directions are different for the respective adjacent two premixing nozzles in the circumferential direction.

A premixing method for a gas turbine combustor according to one aspect of the present invention comprising a plurality of premixing nozzles which are arranged in circumferential direction and form a premixing combustion flame by injecting premixed gas formed by premixing fuel and air into a combustion chamber, is characterized in that air is flown from air flow inlets each being provided for every adjacent two premixing nozzles in the circumferential direction, and swirling flows are formed around the respective adjacent two premixing nozzles.

A premixing method for a gas turbine combustor according to another aspect of the present invention comprising a plurality of premixing nozzles which are arranged in circumferential direction and form a premixing combustion flame by injecting premixed gas formed by premixing fuel and air into a combustion chamber, is characterized in that air is flown from air flow inlets each being provided for every adjacent two premixing nozzles, and swirling flows of which rotating directions are opposite each other are formed around the respective adjacent two premixing nozzles.

A premixing method for a gas turbine combustor according to still another aspect of the present invention comprising a plurality of premixing nozzles which are arranged in circumferential direction and form a premixing combustion flame by injecting premixed gas formed by premixing fuel and air into a combustion chamber, is characterized in that one air flow inlet for every adjacent two premixing nozzles is provided so that swirling flows of which rotating directions are different each other are formed around the respective adjacent two premixing nozzles in the circumferential direction.

BEST MODES FOR CARRYING OUT THE INVENTION

Hereinbelow, embodiments of the present invention will be explained.

In the embodiments of the present invention, a measure is taken that an inlet window is configured in such a manner that the width in circumferential direction of the inlet window varies along the axial direction of a combustor and thereby, such as strength and size of swirls can be controlled so as to obtain the maximum effect.

Further, for the fuel nozzles arranged along the circumferential direction in a premixer one inlet window is assigned for two pieces of the fuel nozzles to form one set so that each set thereof causes to generate a pair of two swirls, thereby number of inlet windows is relatively reduced as well as partition walls in the premixer is also reduced which prevent attenuation of the swirls and further advances the mixing.

Through the reduction of the inlet windows and the partition walls in the premixer the manufacturing cost thereof can be reduced as well as through strengthening and optimizing the swirl further highly uniform premixing gas can be obtained and a combustor showing an excellent low NOx performance can be provided.

(Embodiment 1)

Hereinbelow, a first embodiment of the present invention will be explained with reference to FIG. 1 through FIG. 6.

Figure 6:
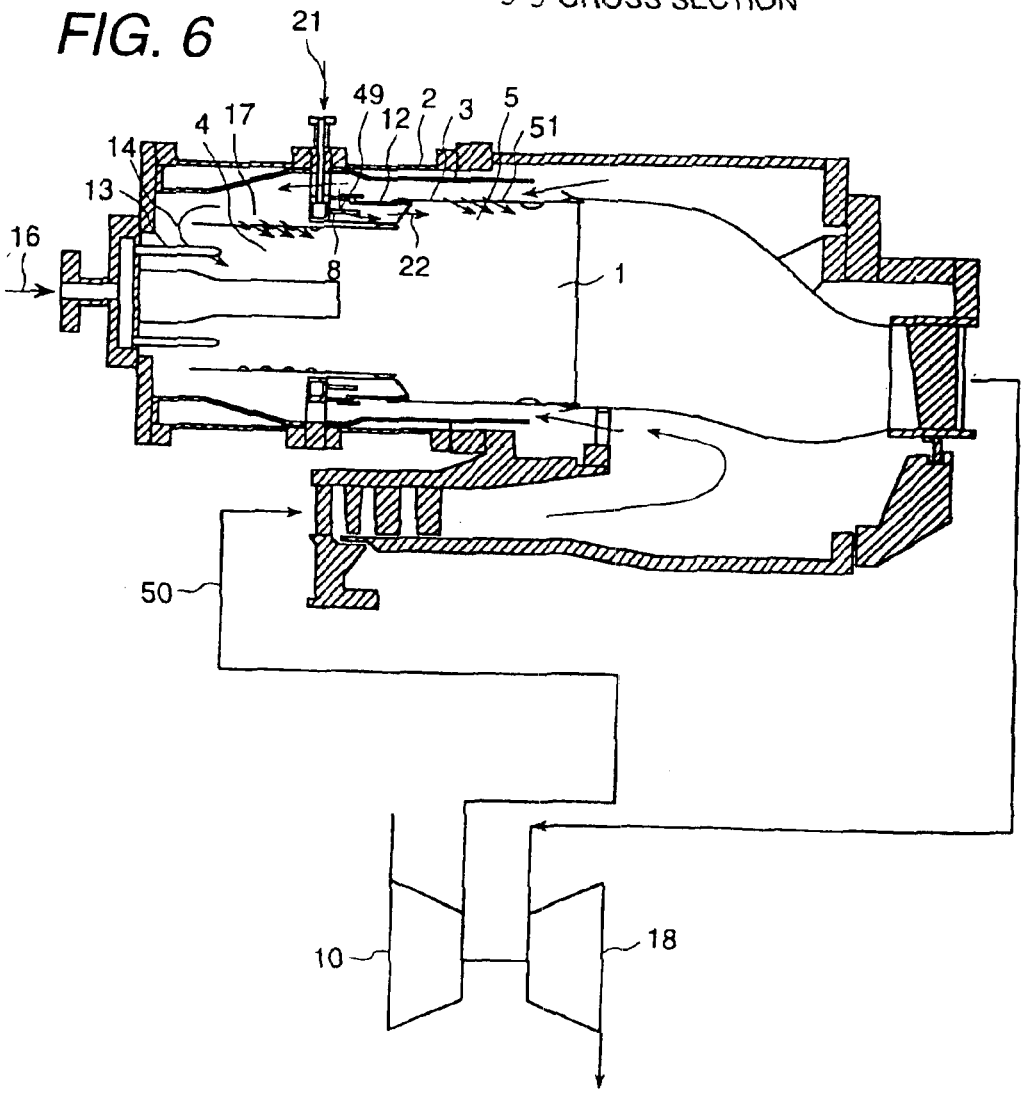
FIG. 6 shows a cross sectional view of the entire structure of the combustor representing the embodiment of the present invention.

FIG. 6 is a cross sectional view of an entire structure of a combustor. The present combustor is an example in which the diffusive combustion showing an excellent stability is preformed at the center portion thereof and the premixing combustion showing an excellent low NOx property is preformed at the outer circumferential side thereof, thereby, a lowering of NOx is achieved.

As shown in FIG. 6, in the combustor air 50 sent from the compressor 10 flows between a combustor outer cylinder 2 and a combustor liner 3. Then, a part of the air flows in into a combustion chamber 1 as cooling air 51 for the combustor liner 3 and a part of the other air flows in into a premixer 12 as premixing use air 49. The remaining air flows in into the combustion chamber 1 from a combustion air hole 14*a*14 and cooling air holes 17 via a passage between the premixer and combustor end plate.

Further, diffusive combustion use fuel 16 is injected into the combustion chamber 1 from diffusion fuel nozzles 13 to from a stable diffusive flame 4. Premixing use fuel 21 is injected from premixing fuel nozzles 8 into an annular shaped premixer 12 to form premixed gas 22 by mixing with air. The premixed gas 22 flows out into the combustor 1 to form a premixing flame 5. Then, the generated high temperature combustion gas is introduced into a turbine 18 to perform work and thereafter exhausted.

In a low NOx combustor making use of such premixing combustion, formation of uniform premixed gas greatly affects the low NOx performance. In particular, in the above conventional example which is structured in such a manner that the air flow makes a U turn at the inlet of the premixer, a drift with regard to air flow is likely caused which makes difficult to form a uniform mixing gas. Namely, for such measure it requires great attention of advancing the mixing in the premixer.

Figure 4:
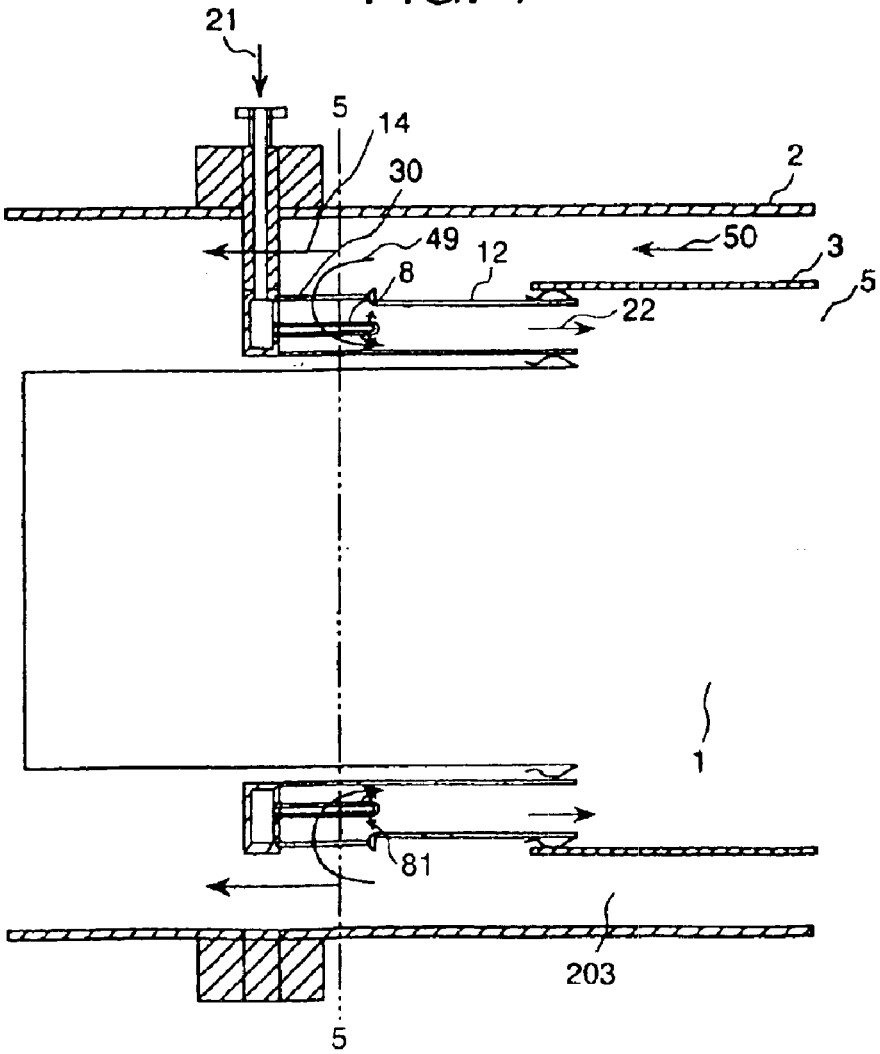
FIG. 4 shows another partial vertical cross sectional view of the combustor representing the embodiment of the present invention.
Figure 5:
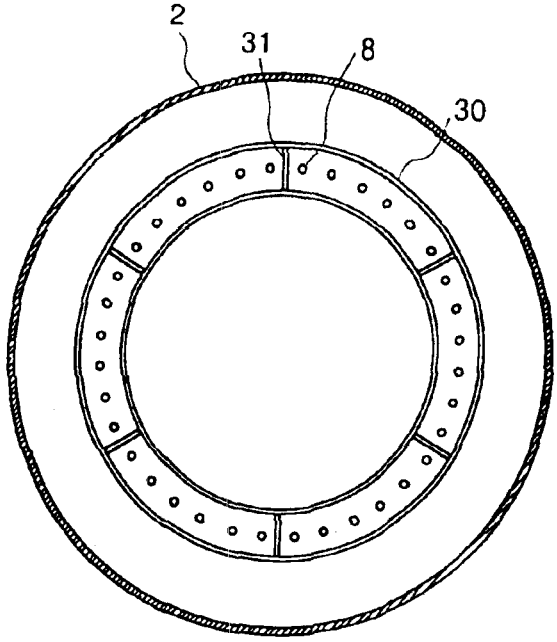
FIG. 5 shows another partial transversal cross sectional view of the combustor representing the embodiment of the present invention.

A partial vertical view of a combustor to which the present invention is applied is shown in FIG. 4, and a partial transversal cross sectional view of the combustor to which the present invention is applied is shown in FIG. 5. The premixing device of the present embodiment is provided with, as shown in FIG. 4 and FIG. 5, the combustor outer cylinder 2, the cylindrical shaped combustor liner 3, the premixer 12 including an annular passage for flowing the gas into the combustor 1, an annular air passage 203 formed by these elements, air inlet opening portions 30 arranged at the outer circumferential side of the premixer 12 and serving as air inlet windows, a plurality of premixing fuel nozzles 8 arranged in the premixer annular passage along the circumferential direction thereof, fuel injection holes 81 bored at the premixing fuel nozzles 81 and a plurality of partitions 31 arranged in the premixer annular passage along the circumferential direction thereof and serving as partition walls.

The combustor outer cylinder 2 is for preventing the high temperature and high pressure air 50 from leaking to the outer atmosphere and for securing combustor members to a gas turbine main body. The combustor liner 3 forms the combustor 1, and of which inner portion combustion reaction between fuel and air is performed to generate high temperature combustion gas and which introduces the high temperature combustion gas to the turbine.

The premixer 12 forms an annular passage, forms the premixed gas 22 in the passage by mixing the fuel and air, flows out the same into the combustor 1, and causes to perform premixing combustion with limited amount of NOx exhaustion.

The air passage 203 is an annular passage for passing the high temperature and high pressure air to the premixer 12.

A plurality of premixing fuel nozzles 8 are arranged in the annular passage near the inlet of the premixer 12 along the circumferential direction thereof so as to properly distribute the fuel, and each of the fuel nozzles 8 is provided with not less than one fuel injection port 81 through which fuel is injected into the premixer 12.

The partitions 31 serving as isolation walls mechanically support the inner and outer circumferential walls of the premixer 12 as well as partition the annular passage of the premixer 12 into a plurality of chambers in circumferential direction thereof.

Figure 1:
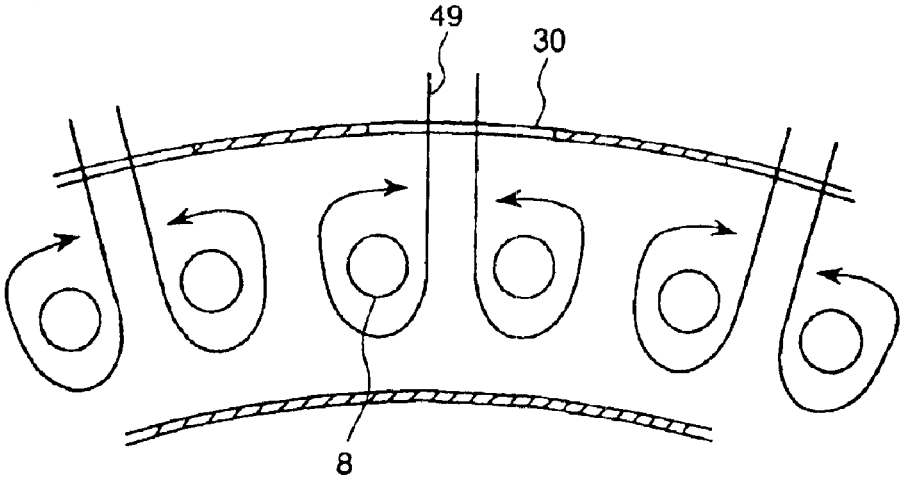
FIG. 1 shows a partial transversal cross sectional view of a combustor representing one embodiment of the present invention.
Figure 2:
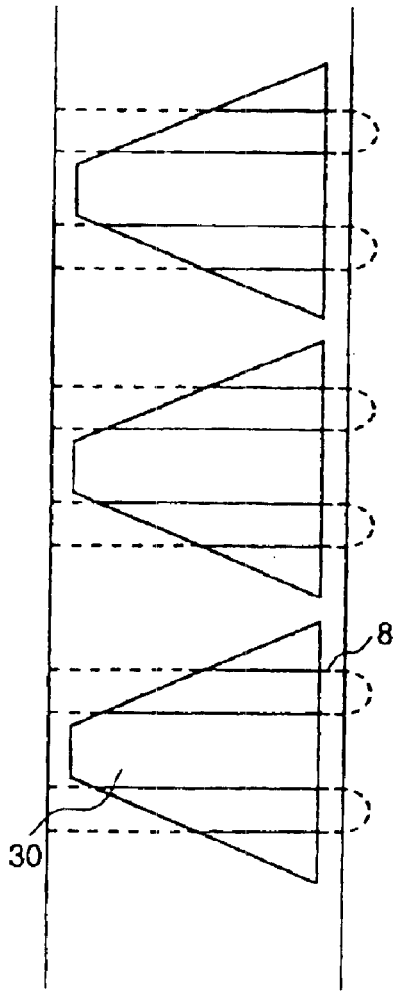
FIG. 2 shows a partial top plane view of the combustor representing the embodiment of the present invention.
Figure 3:
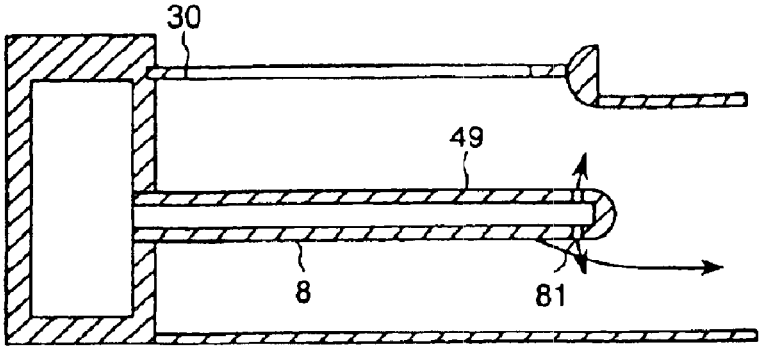
FIG. 3 shows a partial vertical cross sectional view of the combustor representing the embodiment of the present invention.

Now, the present invention will be explained with reference to FIG. 1 through FIG. 3. FIG. 1 shows a partial transversal cross sectional view of a combustor representing one embodiment of the present invention, FIG. 2 shows a partial top plane view of the combustor representing the one embodiment of the present invention and FIG. 3 shows a partial vertical cross sectional view of the combustor representing the one embodiment of the present invention.

In the present embodiment, an air inlet opening portions 30 serving as an air inlet windows form inlet ports through which air flows in from the air passage 203 to the premixer 12, the opening portions are distributedly arranged along the circumferential direction in a rate of for every one opening portion two pieces of fuel nozzles 8 and each of the main opening area is arranged so as to locate at the intermediate position in circumferential direction of the two pieces of fuel nozzles.

The width of the opening portion is configured to gradually decrease in the main air flow direction flowing through the air passage 203, thereby, the opening portions are configured a planform trapezoid shape.

Now, an operation of the embodiment of the present invention will be explained. As shown in FIG. 4, the high temperature and high pressure air 50 sent from the compressor passes through the annular passage 203 formed by the combustor outer cylinder 2, the combustor liner 3 and the premixer 12 and reaches the air inlet opening portions 30 of the premixer 12, where the air 50 is branched into premixing use air 49 flowing into the premixer 12 and air 14 flowing into such as the diffusive combustor.

As shown in FIG. 1, the premixing use air 49 entered into the premixer 12 inverts the flow direction so as to flow along the flow passage of the premixer 12, forms the premixed gas while being mixed with premixing fuel 21 injected from the fuel injection holes 81 of the fuel nozzles 8 disposed in the premixer 12, and then flows out into combustor 1.

In the combustor 1, premixing flame is formed by making use of the high temperature gas in the diffusive combustor at the upstream side as an ignition source or by making use of a proper flame holder (such as a bluff body), and a premixing combustion reaction with limited NOx generation is performed to generate high temperature combustion gas.

Herein, the higher the uniformity of the fuel density in the premixed gas 21, the more the uniformity of temperature of the combustion gas is achieved, thereby a low NOx combustion can be realized while eliminating a high temperature portion which operates as NOx generation source.

Now, processes of mixing fuel and air in the present embodiment will be explained in detail with reference to FIG. 7 through FIG. 24.

At first, configuration of the air inlet window and air flow caused in the premixer will be explained with reference to FIG. 7 through FIG. 12.

Figure 7:
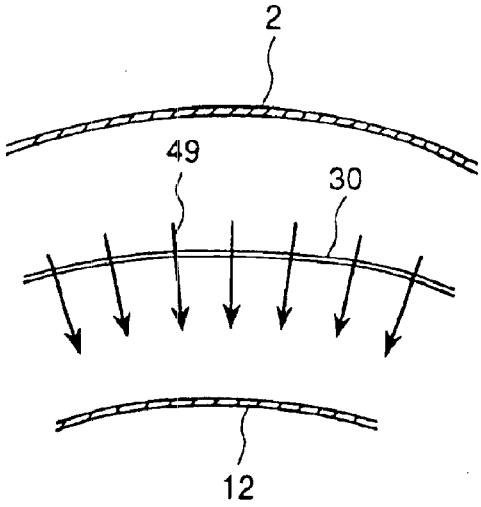
FIG. 7 shows a partial transversal cross sectional view of a combustor representing one embodiment of the present invention.
Figure 8:
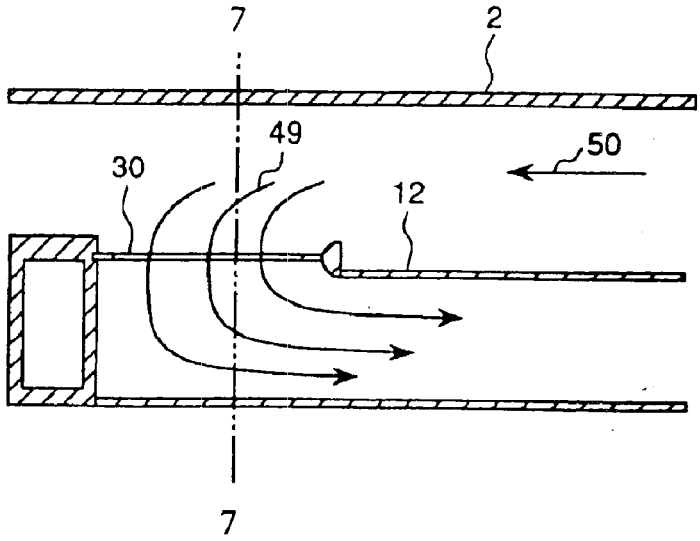
FIG. 8 shows a partial vertical cross sectional view of the combustor representing the embodiment of the present invention.
Figure 9:
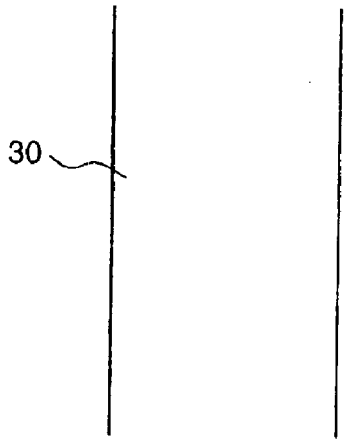
FIG. 9 shows a partial top plane view of the combustor representing the embodiment of the present invention.

As shown in FIG. 7 through FIG. 9 the premixing use air 49 entered into the premixer 12 inverts the flow direction so as to flow along the flow passage of the premixer 12, forms the premixed gas while being mixed with premixing fuel 21 injected from the fuel injection holes 81 of the fuel nozzles 8 disposed in the premixer 12, and then flows out into the combustor 1. Herein, for simplicity's sake, at first only the air flow will be explained while omitting the fuel nozzles. As shown in FIG. 9, when the window is configured in a one large continuous opening along the entire circumferential direction, namely, the air inlet opening portions 30 are provided continuously along the circumferential direction, as shown in FIGS. 7 and 8, the air flow in the premixer 12 assumes a laminar air flow with small secondary flow in the flow passage cross section and the mixing between fuel and air is not sufficiently advanced. Further, along the inner surface of the premixer outer circumferential side wall where the air flow is inverted break away vortexes having axis in circumferential direction are likely caused. Since these vortexes are unstable and occasionally break away and are discharged toward downstream while being carried on the air flow, these vortexes are considered as one of the causes which induces a back fire phenomenon causing flame at the downstream side.

Figure 10:
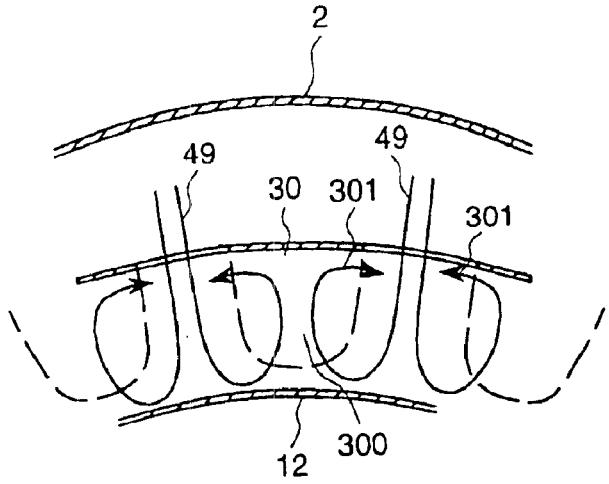
FIG. 10 shows a partial transversal cross sectional view of a combustor representing one embodiment of the present invention.
Figure 11:
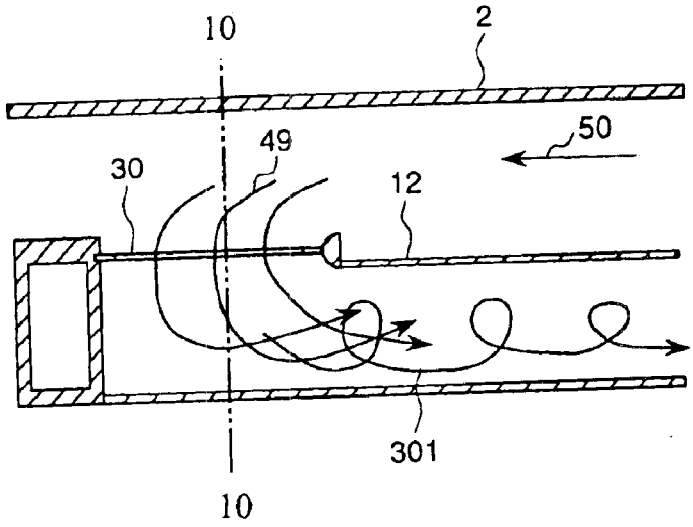
FIG. 11 shows a partial vertical cross sectional view of the combustor representing the embodiment of the present invention.
Figure 12:
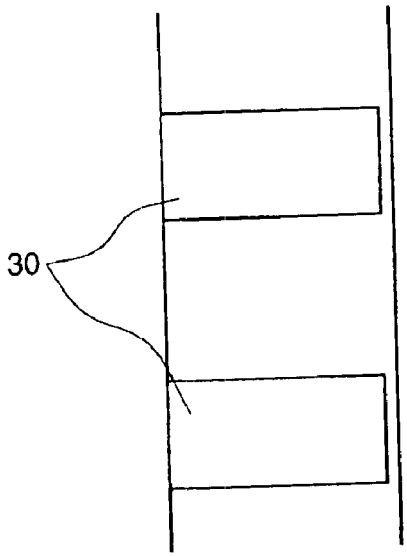
FIG. 12 shows a partial top plane view of the combustor representing the embodiment of the present invention.

On the other hand, as shown in FIG. 10 through FIG. 12, in the present embodiment, the opening portions are distributed along the circumferential direction. Namely, the air inlet opening portions 30 are provided discontinuously along the circumferential direction. Therefore, as shown in FIGS. 10 and 11, a negative pressure region 300 is formed due to flow break away at the back face between the adjacent two air inlet openings 30 serving as inlet air windows and a pair of stable vortexes 301 are formed around the negative pressure region 300. Further, as shown in FIG. 10, the swirling directions of the generated adjacent vortexes 301 are opposite direction each other when seen along the circumferential direction of the combustor. These vortexes 301 extend downstream side in the axial direction while gradually attenuating due to friction loss with the inner face of the premixer wall, greatly agitate the air in the flow passage cross section in the premixer and advance mixing between fuel and air.

Figure 13:
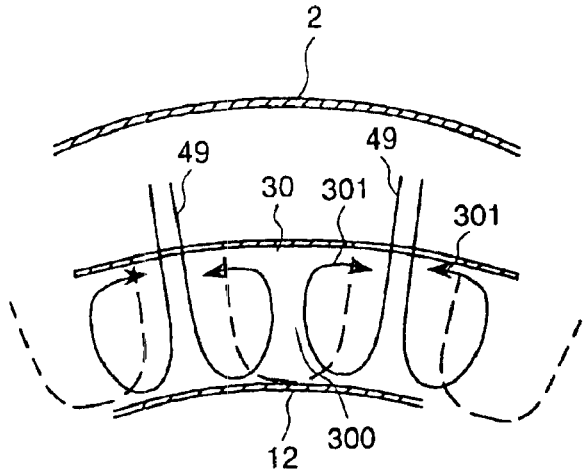
FIG. 13 shows a partial transversal cross sectional view of a combustor representing one embodiment of the present invention.

Now, with reference to FIGS. 13 through 15 and FIGS. 16 through 18, difference in effect, when the opening width of the air inlet opening portions 30 serving as air inlet windows is varied in the main flow direction of the air, will be explained. FIG. 13 is a partial transversal cross sectional view of the combustor representing the one embodiment of the present invention, FIG. 14 is a partial vertical cross sectional view of the combustor representing the one embodiment of the present invention, and FIG. 15 is a partial top plane view of the combustor representing the one embodiment of the present invention.

Figure 14:
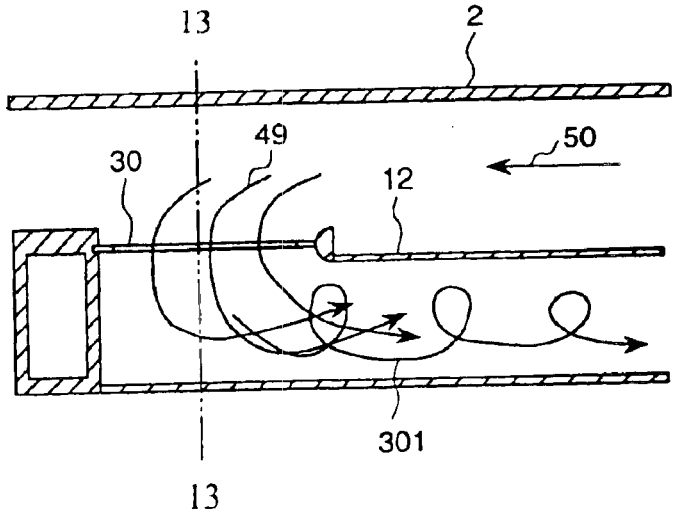
FIG. 14 shows a partial vertical cross sectional view of the combustor representing the embodiment of the present invention.
Figure 15:
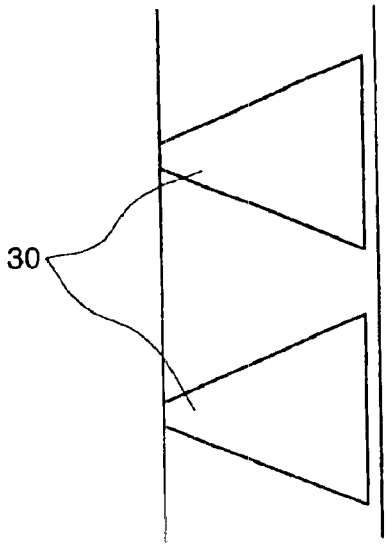
FIG. 15 shows a partial top plane view of the combustor representing the embodiment of the present invention.

The embodiment as shown in FIGS. 13 through 15 illustrates a state of the vortexes 301 when the opening portions are configured nearly triangular shape in such a manner that the width thereof gradually decreases in the main flow direction of the air 50 in the air flow passage 203 (directing in opposite direction from the premixing air flow direction). In this instance, the vortexes spread entirely toward the inner circumferential side of the premixer flow passage and a further strong agitating and mixing action can be obtained.

Figure 16:
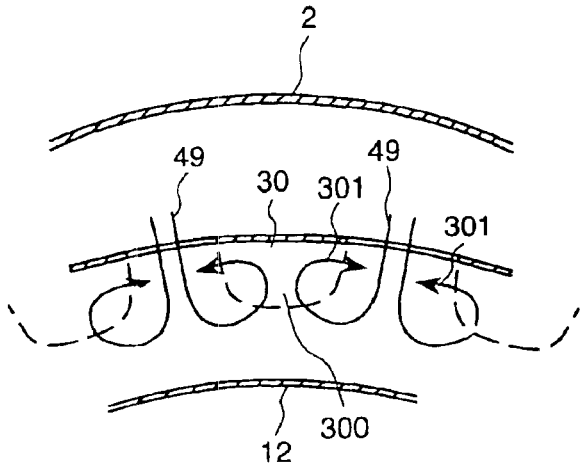
FIG. 16 shows a partial transversal cross sectional view of a combustor representing one embodiment of the present invention.
Figure 17:
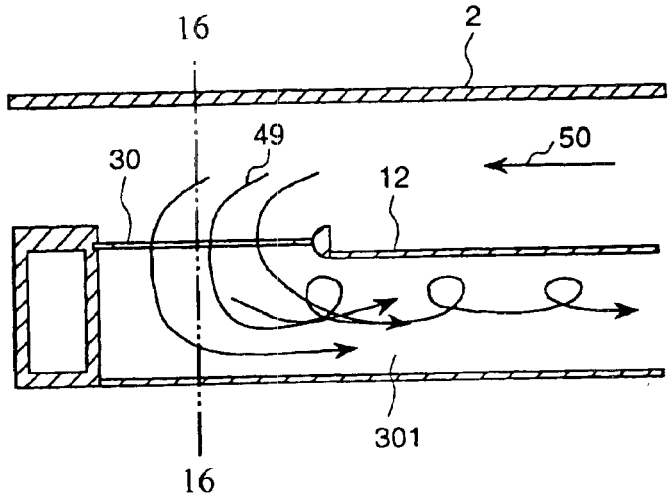
FIG. 17 shows a partial vertical cross sectional view of the combustor representing the embodiment of the present invention.
Figure 18:
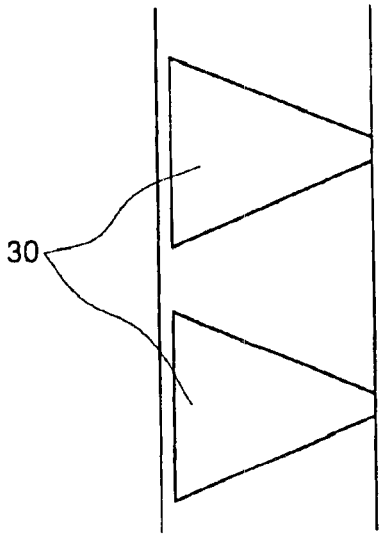
FIG. 18 shows a partial top plane view of the combustor representing the embodiment of the present invention.

Further, FIG. 16 is a partial transversal cross sectional view of the combustor representing the one embodiment of the present invention, FIG. 17 is a partial vertical cross sectional view of the combustor representing the one embodiment of the present invention, and FIG. 18 is a partial top plane view of the combustor representing the one embodiment of the present invention.

The embodiment as shown in FIGS. 16 through 18 illustrates a state of the vortexes 301 when the opening portions are configured in such a manner that contrary to the above the width thereof gradually increases in the main air flow direction in the air flow passage 203 in the manner broadening along the stream. In this instance, the vortexes 301 are relatively confined at the outer circumferential side of the premixer and the agitating and mixing action thereof is also comparatively small.

In a case when the configuration of the air inlet window is not varied in the flow direction which corresponds to the example as shown in FIGS. 10 through 12, the agitating and mixing action thereof shows an intermediate one of the above explained two examples.

As has been explained above, through distribution of the premixer air inlet windows 30 in circumferential direction and formation in the premixer of a pair of vortexes of which swirling directions are opposing each other, the mixing between fuel and air in the premixer can be advanced.

Further, through configuring the air inlet opening portions 30 serving as the premixer air inlet window nearly a triangular shape in such a manner the width thereof gradually decreases in the flow direction of the air 50, the size and strength of the vortexes 301 can be increased, thereby, the agitating and mixing action thereof is further strengthened.

Figure 19:
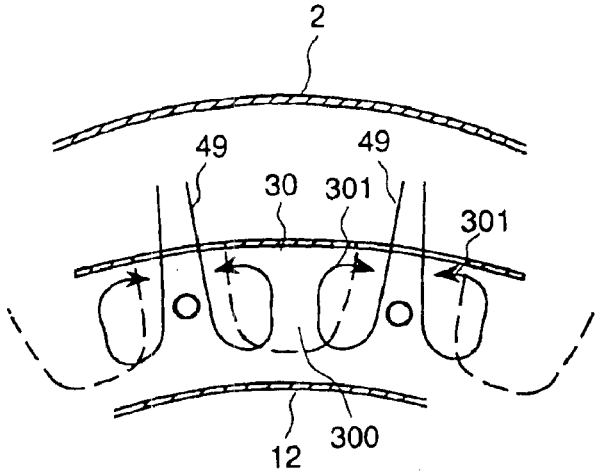
FIG. 19 shows a partial transversal cross sectional view of a combustor representing one embodiment of the present invention.

Now, a relationship between position of the air inlet window 30 and premixing fuel nozzles 18 and mixing process will be explained with reference to FIGS. 19 through 21 and FIGS. 22 through 24. FIG. 19 is a partial transversal cross sectional view of the combustor representing the one embodiment of the present invention, FIG. 20 is a partial vertical cross sectional view of the combustor representing the one embodiment of the present invention, and FIG. 21 is a partial top plane view of the combustor representing the one embodiment of the present invention, FIG. 22 is a partial transversal cross sectional view of the combustor representing the one embodiment of the present invention, FIG. 23 is a partial vertical cross sectional view of the combustor representing the one embodiment of the present invention, and FIG. 24 is a partial top plane view of the combustor representing the one embodiment of the present invention.

Figure 20:
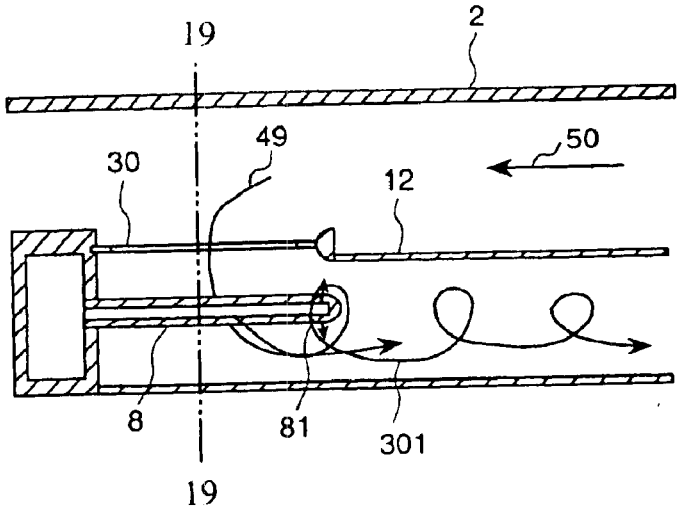
FIG. 20 shows a partial vertical cross sectional view of the combustor representing the embodiment of the present invention.
Figure 21:
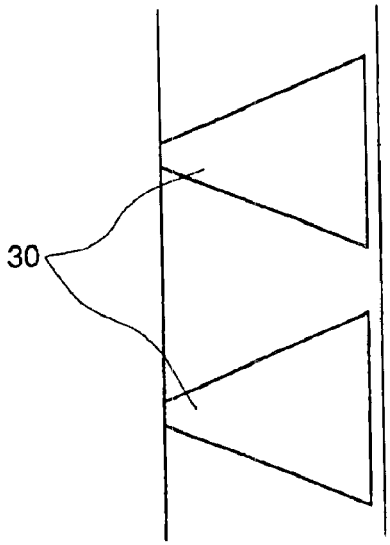
FIG. 21 shows a partial top plane view of the combustor representing the embodiment of the present invention.

In FIGS. 19 through 21, the premixing fuel nozzles 8 are disposed so as to locate immediately below the centers of the air inlet windows 30. Namely, the premixing fuel nozzles 8 are located substantially on the lines connecting between the air inlet windows 30 and the axial center of the combustor. In this instance, the vortexes 301 are formed between the adjacent premixing fuel nozzles 8, however, the premixing fuel nozzles 8 operate so as to disturb the main flow of the premixing use air 49 therefore, the vortexes 301 are comparatively small and gentle.

Figure 22:
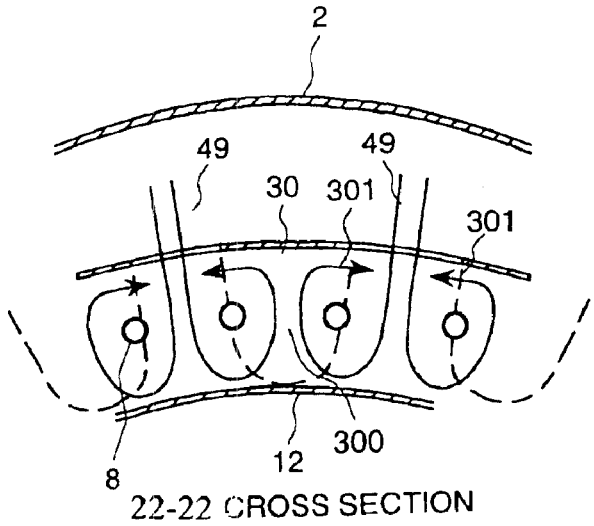
FIG. 22 shows a partial transversal cross sectional view of a combustor representing one embodiment of the present invention.
Figure 23:
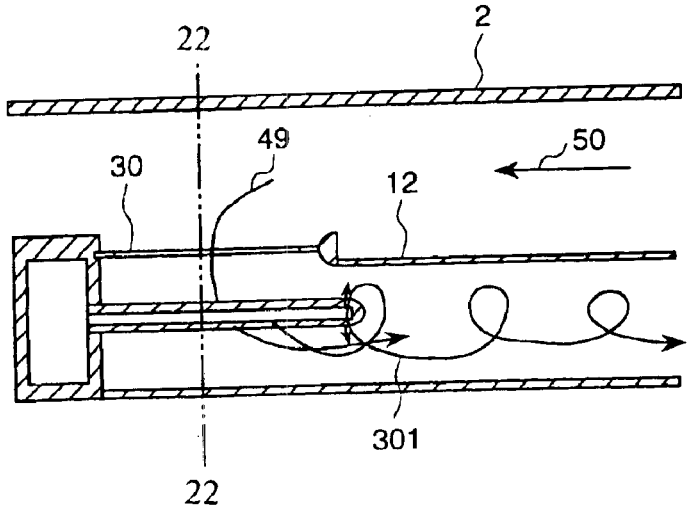
FIG. 23 shows a partial vertical cross sectional view of the combustor representing the embodiment of the present invention.
Figure 24:
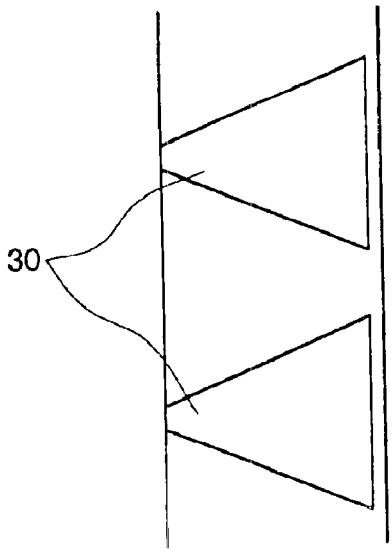
FIG. 24 shows a partial top plane view of the combustor representing the embodiment of the present invention.

On the other hand, FIGS. 22 through 24 relate to the embodiment of the present invention wherein the air inlet opening portions serving as the air inlet windows are disposed in such a manner the centers of the openings locate substantially the intermediate of the adjacent premixing fuel nozzles. In this instance, large and strong vortexes 301 are formed so as to surround the premixing fuel nozzles 8, thereby, an excellent agitating and mixing effect can be obtained.

In the present embodiment, for each of the premixing inlet air windows since a pair of vortexes of which swirling directions are opposing are formed, the swirling directions of the vortexes for adjacent premixer inlet air windows are also directing oppositely each other, thereby, interference therebetween hardly occurs. Therefore, different from the conventional structure which necessitates partitions 31 serving as the isolation walls partitioning the premixer flow passage for every window along the circumferential direction, however, in the present embodiment it is sufficient if the minimum number of isolation walls is provided which maintains mechanical strength required for the premixer. Namely, the partition can be omitted to take an easy structure or the partitions 31 can be simplified. Generally, a major cause of attenuation of the vortexes 301 which advance the mixing is an attenuation due to friction loss with the premixer walls, with the premixer inlet air windows according to the present embodiment the attenuation of the formed vortexes can be extremely limited, thereby, further uniform premixed gas can be formed.

To put this differently, the length of the premixer necessary for obtaining the premixed gas having the same uniformity can be shortened and effect of cost reduction and freedom for designing can be enhanced.

Further, the unstable break away vortexes in the circumferential direction are hardly formed which possibly contributes to reduce negative potentials such as back fire.

At the same time, as in the present embodiment, the number of isolation walls can be minimized, which also contributes manufacturing cost reduction.

(Embodiment 2)

Figure 25:
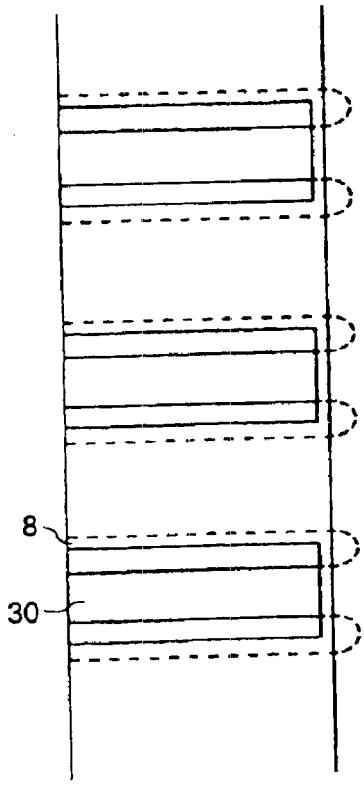
FIG. 25 shows a partial top plane view of a combustor representing one embodiment of the present invention.

A second embodiment of the present invention will be explained with reference to FIG. 25. Although the basic structure of the present invention is the same as that of the first embodiment, a different point thereof is that the width of the air inlet opening portions 30 is kept unchanged in the main flow direction of air. Through thus constituting, although the agitating and mixing performance thereof somewhat reduces as has been explained above, easiness of parts manufacturing and assembling the same can be enhanced.

(Embodiment 3)

Figure 26:
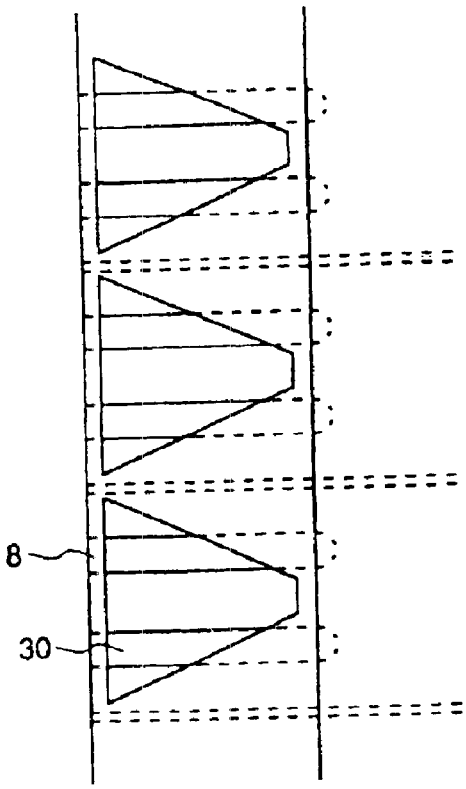
FIG. 26 shows a partial top plane view of a combustor representing another embodiment of the present invention.

A third embodiment of the present invention will be explained with reference to FIG. 26. Although the basic structure of the present invention is the same as that of the first embodiment, a different point thereof is that the air inlet opening portions 30 are configured into nearly a triangular shape in such a manner that the width thereof is broadened in the main flow direction of the air. Through thus constituting, the swirling vortex generation sources at the downstream side of the windows are limited in a narrow range in comparison with other embodiments as has been explained above and comparatively gentle mixing can be realized and the present embodiment is effective in a case where the mixing degree at the inner circumferential side is required to be gentle in view of interference with the diffusive combustion at the upstream side.

Figure 30:
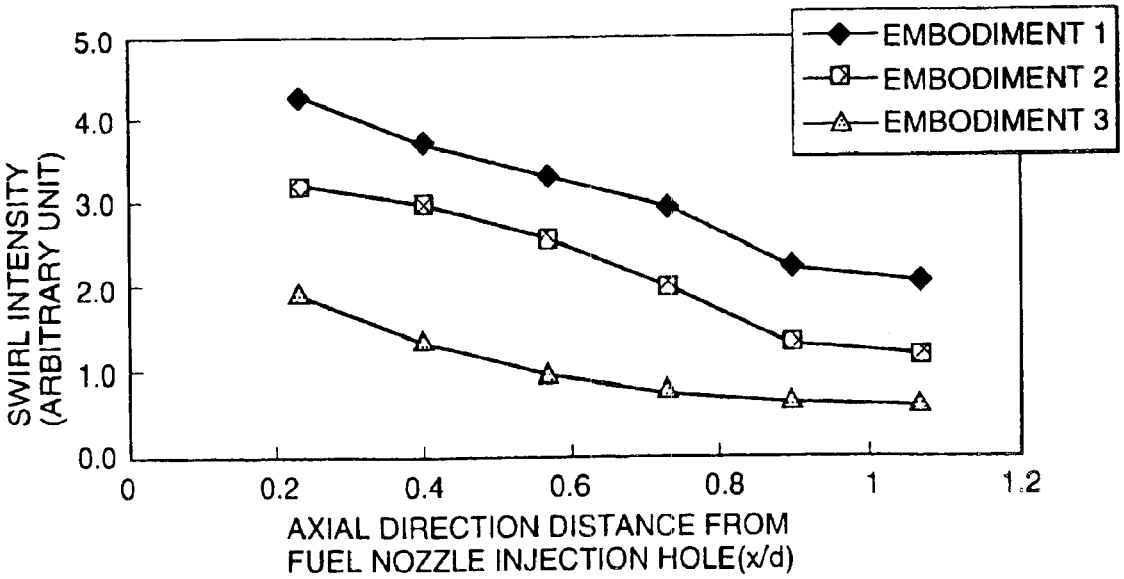
FIG. 30 is a diagram in which swirling intensities of three embodiments are compared.

Now, comparison result of swirling intensity of vortexes with regard to the above embodiments 1 through 3 will be explained with reference to FIG. 30. FIG. 30 is a diagram in which the swirling intensities of these are compared. The abscissa represents axial direction distance from the premixing nozzle injection hole with no dimension and the ordinate represents swirl intensity.

These swirling intensities are higher than conventional ones and the attenuation of the swirling intensity in the axial direction is low in comparison with conventional ones.

Among these, it is observed that the swirling intensity of the embodiment 1 is generally high. Namely, in the case of nearly triangular shaped opening portion wherein the width thereof gradually decreases in the main air flow direction, it is observed that the swirling intensity thereof is extremely high.

Figure 31:
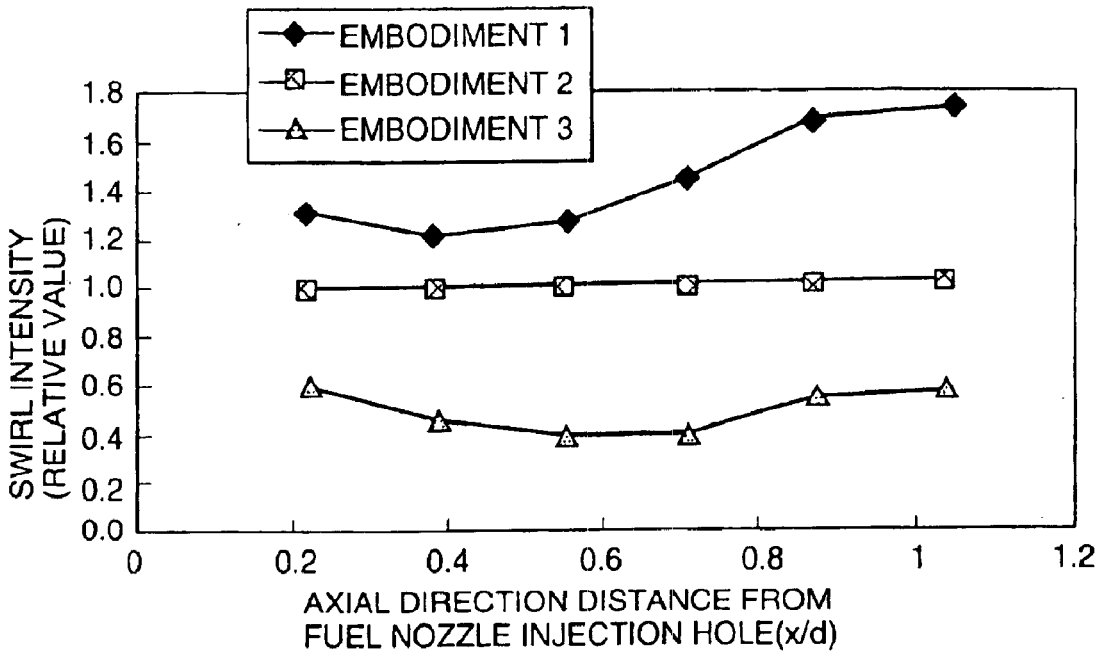
FIG. 31 is a diagram in which attenuations of the swirling intensities of three embodiments are compared using embodiment 2 as reference.

Further, with regard to the embodiments 1 through 3, comparison on attenuation of the vortex swirling intensities will be explained with reference to FIG. 31. FIG. 31 is a diagram in which the attenuation of swirling intensities of three embodiments is compared using that of the embodiment 2 as reference. The abscissa represents axial direction distance from the premixing nozzle injection hole with no dimension, and the ordinate represents relative swirling intensity when assuming that of embodiment 2 as 1.

Among the embodiments 1 through 3, the swirling intensity of embodiment 1 is generally high and when comparing with the embodiment 2, even if the axial direction distance is prolonged, it is observed that the swirling intensity is hardly attenuated. Namely, in the case of nearly triangular shaped opening portion wherein the width thereof gradually decreases in the main air flow direction (directing in opposite direction from the premixed gas flow direction), it is observed that the swirling intensity thereof is hardly reduced.

As has been explained above, with the present embodiment the attenuation of vortexes formed by the premixer inlet air windows can be minimized and further uniform mixed gas can be formed, thereby, the present embodiment contributes to enhance low NOx performance. The length of the premixer necessary for obtaining the premixed gas having the same uniformity can be shortened and effect of cost reduction and freedom for designing can be enhanced. Further, the unstable break away vortexes in the circumferential direction are hardly formed which possibly contributes to reduce negative potentials such as back fire. At the same time, as in the present embodiment, the number of isolation walls can be minimized, which also contributes to manufacturing cost reduction.

(Embodiment 4)

Figure 27:
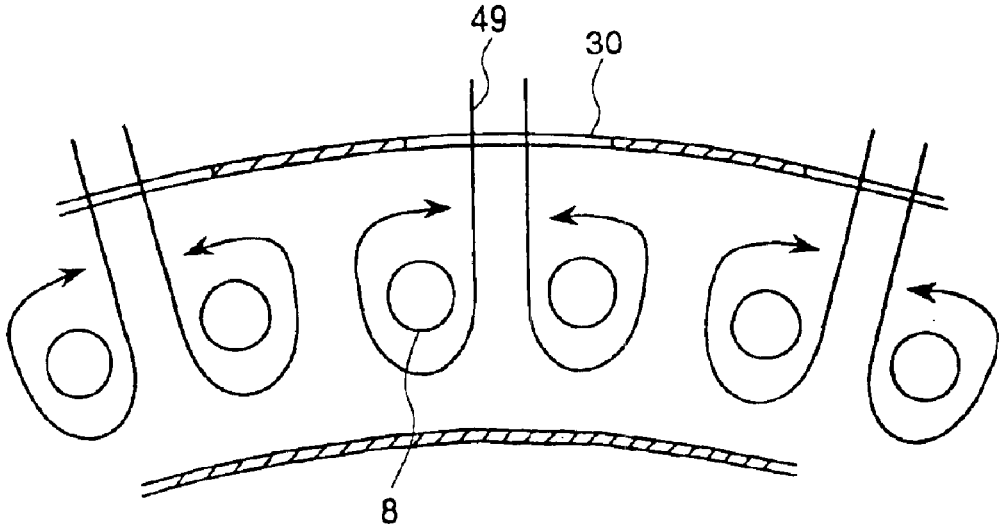
FIG. 27 shows a partial transversal cross sectional view of a comparator representing still another embodiment of the present invention.
Figure 28:
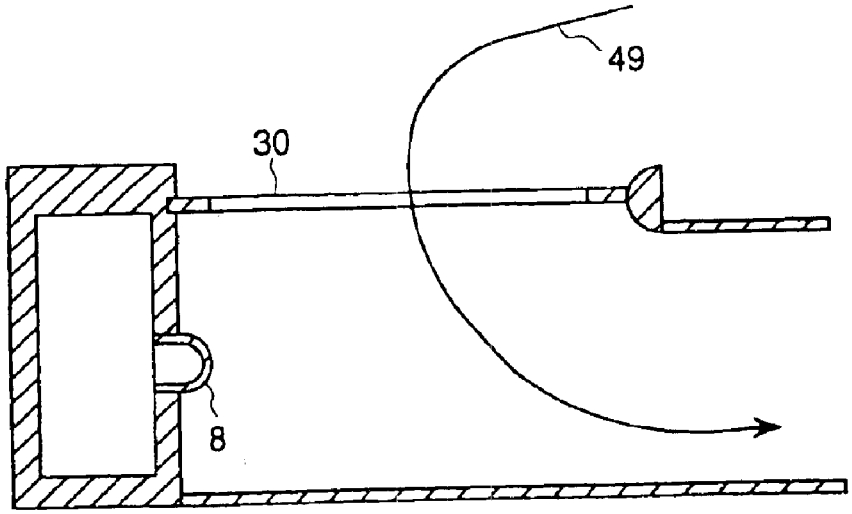
FIG. 28 shows a partial vertical cross sectional view of the combustor representing the embodiment of the present invention.
Figure 29:
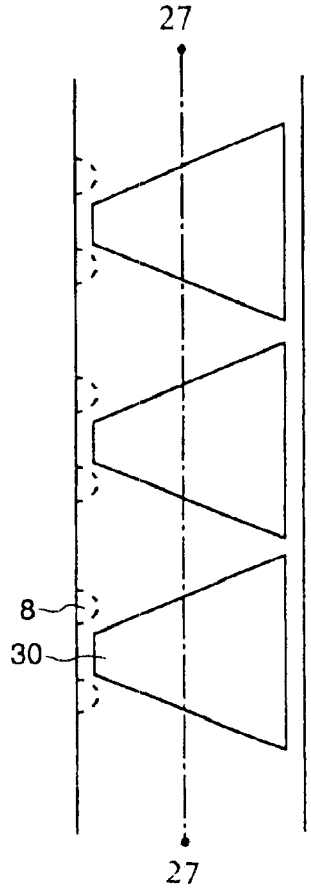
FIG. 29 shows a partial top plane view of the combustor representing the embodiment of the present invention.

A fourth embodiment of the present invention will be explained with reference to FIGS. 27 though 29. Although the basic structure of the present invention is the same as that of the first embodiment, a different point thereof is that the fuel nozzle is shortened and is disposed on the wall face of the premixer. In the case as in the present embodiment where the paired two vortexes are generated, since the swirling directions of the adjacent vortexes are always directed in opposite direction, stability of the swirling vortexes is high, therefore, it is necessarily required to extend the fuel nozzles forward, thus it is possible to dispose the fuel injection holes directly on the wall face. Through thus constructing the fuel nozzles themselves can be simplified which is effective for cost reduction.

(Embodiment 5)

Figure 32:
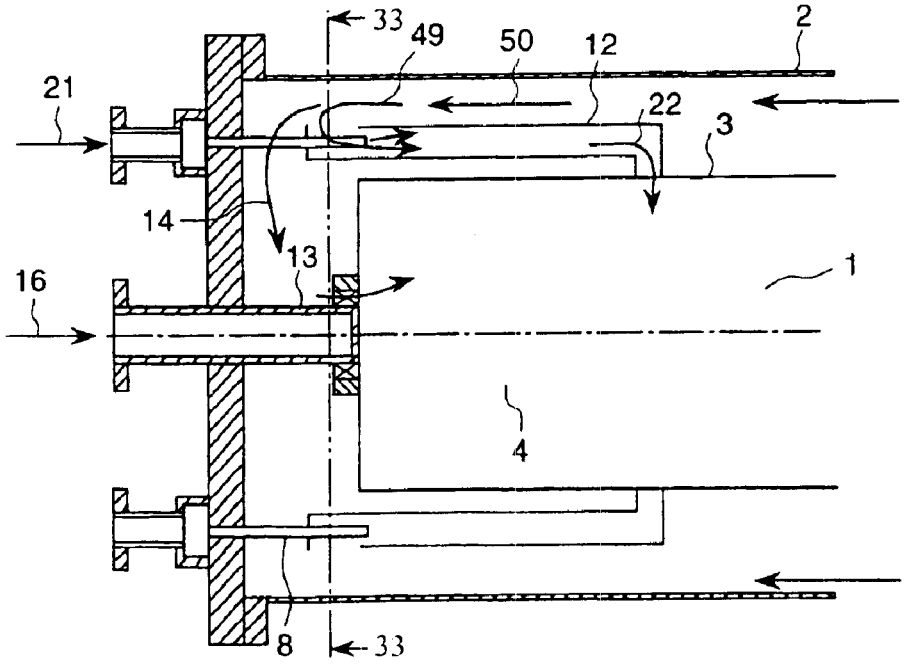
FIG. 32 shows a partial vertical cross sectional view of a combustor to which the present invention is applied.
Figure 33:
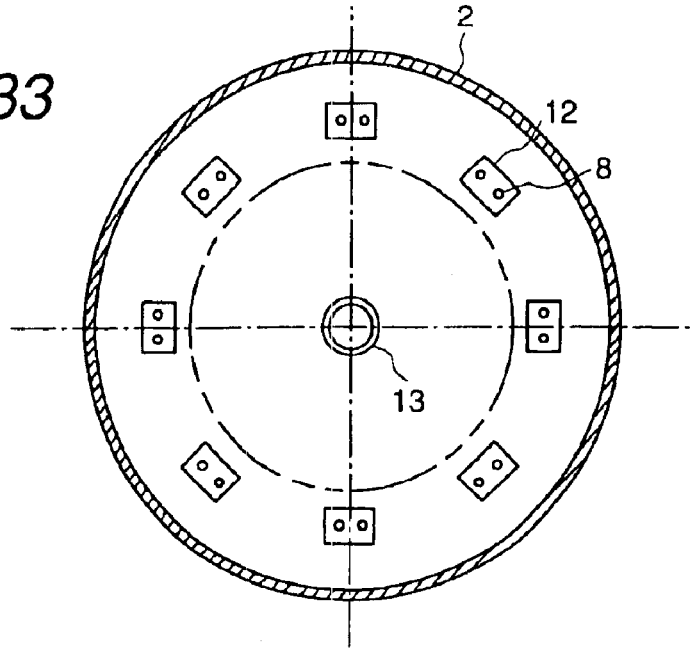
FIG. 33 shows a partial transversal cross sectional view of the combustor to which the present invention is applied.

FIG. 32 shows a partial vertical cross sectional view of a combustor to which the present invention is applied and FIG. 33 shows a partial transversal cross sectional view of the combustor to which the present invention is applied. In the present embodiment, in particular, the premixing fuel 21 for the premixing fuel nozzles 8 is introduced from the same direction (toward downstream side of the main flow direction) as the diffusive combustion use fuel 16 supplied for the diffusion nozzles 13.

The premixing device includes the combustor outer cylinder 2, the cylindrical shaped combustor liner 3 and a plurality of premixing fuel nozzles 8 including the flow passages leading to the combustion chamber 1 and disposed in each of the premixer passages in the circumferential direction thereof.

The combustor outer cylinder 2 is for preventing the high temperature and high pressure air 50 from leaking to the outer atmosphere and for securing combustor members to a gas turbine main body. The combustor liner 3 forms the combustor 1, and of which inner portion combustion reaction between fuel and air is performed to generate high temperature combustion gas and which introduces the high temperature combustion gas to the turbine. In the premixer 12 a part of the air 14 and 50 sent in the main flow direction flows into the premixer flow passage as the premixing air and, in the passage premixed gas 22 is formed by mixing the fuel and air to flow out the same into the combustor 1, and thereby to cause to perform premixing combustion with limited amount of NOx exhaustion. Further, the air 14, the other part of the air 50, is sent to the diffusion side.

A plurality of sets of premixing fuel nozzles 8, each set includes a plurality of premixing fuel nozzles 8, are arranged in the passage near the inlet of the premixer 12 along the circumferential direction thereof so as to properly distribute the fuel. The flow passages are formed for every set so as to surround the respective sets. In the present embodiment, as shown in FIG. 33, two premixing fuel nozzles 8 form one set and a flow passage which surrounds the two premixing fuel nozzles 8 (a set of premixing fuel nozzles 8) is provided for every set.

Figure 34:
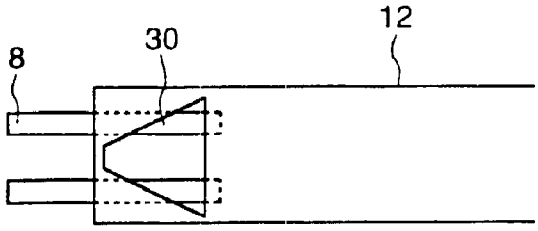
FIG. 34 shows a partial top plane view of the combustor representing the embodiment of the invention.
Figure 35:
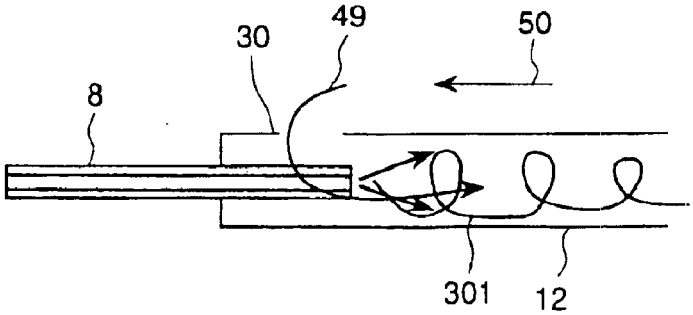
FIG. 35 shows a partial vertical cross sectional view of the combustor representing the embodiment of the present invention.
Figure 36:
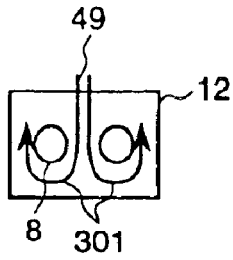
FIG. 36 shows a partial transversal cross sectional view of the combustor representing the embodiment of the present invention.

In the present embodiment as shown in FIG. 34, air inlet opening portions 30 serving as air inlet windows form inlet ports through which air flows to the premixer 12, opening portions are distributedly arranged along the circumferential direction in a rate of for every one opening portion two pieces of premixing fuel nozzles 8 and each of the main opening area is arranged so as to locate at the intermediate position in circumferential direction of the two pieces of premixing fuel nozzles. Further, the width of the opening portion is configured to gradually decrease in the main air flow direction, thereby, the opening portions are configured. Still further as shown in FIGS. 35 and 36, the premixing use air 49 entered into the premixer respectively inverts the flow direction so as to flow along the flow passage of the premixer 12 to thereby form the swirling flow 301. Even with this structure, a swirling flow having high swirling intensity can be formed.

(Embodiment 6)

Figure 37:
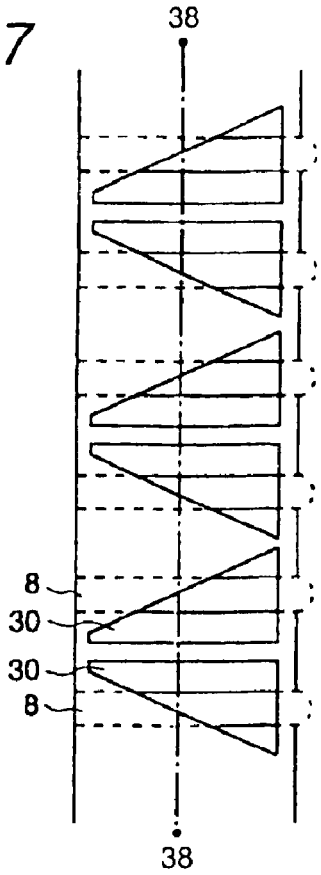
FIG. 37 shows a partial top plane view of a combustor representing a further embodiment of the present invention.
Figure 38:
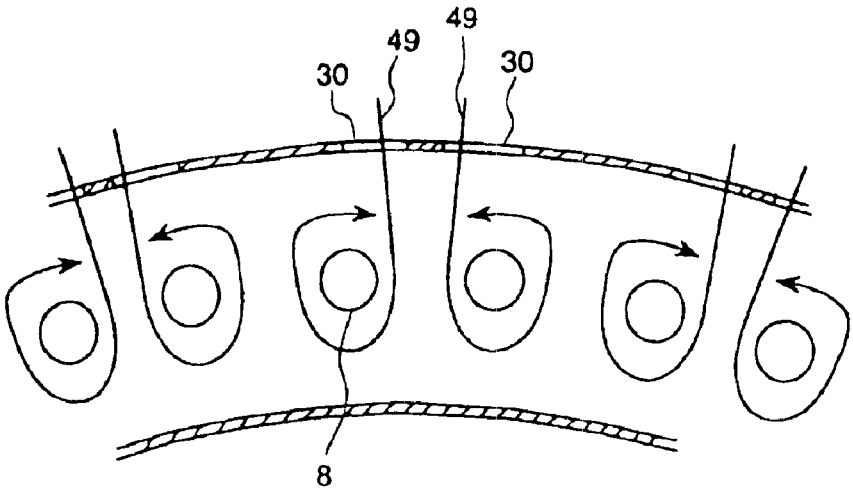
FIG. 38 is a partial transversal cross sectional view of the combustor representing the embodiment of the present invention.

FIGS. 37 and 38 show another configuration of the inlet window. The present embodiment is an exemplary measure in which the swirling directions of vortexes formed around the adjacent two premixing fuel nozzles 8 are direction in opposite directions each other.

Namely, for the respective adjacent two premixing fuel nozzles 8 a corresponding inlet window is formed and the opening area of the respective inlet windows is gradually reduced toward outside near from the centers of the respective premixing fuel nozzles 8. Further, each of the opening portion areas is gradually reduced in the main stream direction. With this structure, the swirling directions formed around the adjacent two premixing fuel nozzles 8 are directed in opposite directions each other and a swirling flow having high swirling intensity can be formed.

Further, when put this differently, a nearly triangular shaped inlet portion of which opening portion area is gradually decreased toward the main stream direction is provided for every adjacent two premixing fuel nozzles 8, thereby, an interrupting portion which prevents air flow is formed near the center of the nearly rectangular shaped inlet portion. Through thus constituting, the swirling directions formed around the adjacent two premixing fuel nozzles 8 are directed in opposite directions each other and a swirling flow having high swirling intensity can be formed.

Figure 39:
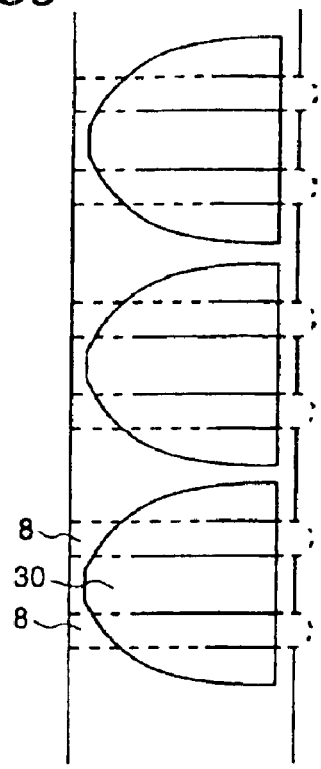
FIG. 39 is a partial top plane view of a combustor representing a still further embodiment of the present invention.

Further, the gradually reducing opening portion area toward the main stream direction of the nearly rectangular shaped inlet portion can be formed in a curved shape as shown in FIG. 39.

INDUSTRIAL FEASIBILITY

According to the present invention a premixer for gas turbine combustors, a premixing method for gas turbine combustors, a gas turbine combustor and a combustion method for gas turbines which uniformalize the premixing and show an excellent low NOx performance can be provided.

What is claimed is:

1. A gas turbine combustor comprising a combustion chamber, diffusive combustion nozzles which inject fuel into air in said combustion chamber to form a diffusive combustion flame, an annular premixing flow passage formed by outer and inner walls in said combustion chamber and premixing nozzles disposed in said premixing flow passage for injecting fuel therein to mix with air to form a premixed gas, which flows out into said combustion chamber to form a premixing flame, characterized in that a plurality of said premixing nozzles are mounted in spaced relationship in said premixing flow passage;

a plurality of spaced openings are formed in said outer wall through which air flows to mix with fuel from said premixing nozzles and form a swirling flow with respect to each of said premixing nozzles along an axial direction of said premixing flow passage; and said openings are disposed in a circumferential direction whereby one opening is provided for each two adjacent nozzles at an intermediate position between the two adjacent nozzles in the circumferential direction.

2. A gas turbine combustor according to claim 1 wherein said swirling flows for said two adjacent nozzles rotate in opposite directions.

3. A gas turbine combustor according to claim 1, characterized in that each of said openings is configured in such a manner that a width of each opening in a circumferential direction varies along an axial direction thereof.

4. A gas turbine combustor comprising a combustion chamber, diffusive combustion nozzles which inject fuel into air in said combustion chamber to form a diffusive combustion flame, an annular premixing flow passage formed by outer and inner walls in said combustion chamber and premixing nozzles disposed in said premixing flow passage for injecting fuel therein to mix with air to form a premixed gas, which flows out into said combustion chamber to form a premixing flame, characterized in that a plurality of said premixing nozzles are mounted in spaced relationship in said premixing flow passage;

a plurality of spaced openings are formed in said outer wall through which air flows to mix with fuel from said premixing nozzles and form a swirling flow with respect to each of said premixing nozzles;

said openings are disposed in a circumferential direction whereby one opening is provided for each two adjacent nozzles;

each of said openings is configured in such a manner that a width of each opening in a circumferential direction varies along an axial direction thereof; and each of said openings is configured in a generally triangular shape in such a manner either that the opening broadens in a main air stream direction prior to air flowing into the premixing flow passage or that the opening decreases in the main air stream direction prior to air flowing into the premixing flow passage.

5. A gas turbine combustor using a premixing device comprising a plurality of premixing nozzles which are arranged in a circumferential direction and form a premixing combustion flame by injecting premixed gas formed by premixing fuel and air into a combustion chamber, characterized in that one air flow inlet for every adjacent two premixing nozzles is provided at an intermediate position between the two adjacent nozzles in the circumferential direction so that a swirling flow is formed with respect to each of said adjacent two premixing nozzles along and around each of said adjacent two premixing nozzles.

6. A gas turbine combustor using a premixing device comprising a plurality of premixing nozzles which are arranged in a circumferential direction and form a premixing combustion flame by injecting premixed gas formed by premixing fuel and air into a combustion chamber, characterized in that one air flow inlet for every adjacent two premixing nozzles is provided at an intermediate position between the two adjacent nozzles in the circumferential direction so that a swirling flow is formed with respect to each of said two adjacent premixing nozzles along and around each of said adjacent two premixing nozzles and said swirling flows for said two adjacent nozzles rotate in opposite directions.

7. A premixing method for a gas turbine combustor comprising a plurality of premixing nozzles which are arranged in a circumferential direction and form a premixing combustion flame by injecting premixed gas formed by premixing fuel and air into a combustion chamber, characterized in that air flows in from air flow inlets, with one of said air inlets being provided for every adjacent two premixing nozzles at an intermediate position between the two adjacent nozzles in the circumferential direction, and a swirling flow is formed along and around each of said adjacent two premixing nozzles.

8. A premixing method for a gas turbine combustor comprising a plurality of premixing nozzles which are arranged in circumferential direction and form a premixing combustion flame by injecting premixed gas formed by premixing fuel and air into a combustion chamber, characterized in that air flows in from air flow inlets, with one of said inlets being provided for every adjacent two premixing nozzles at an intermediate position between the two adjacent nozzles in the circumferential direction, and a swirling is formed along and around said adjacent two premixing nozzles, and said swirling flows for said two adjacent nozzles rotate in opposite directions.

* * * * *